US012704334B1

(12) United States Patent
Chen et al.

(10) Patent No.: US 12,704,334 B1
(45) Date of Patent: Aug. 11, 2026

(54) MULTIFUNCTIONAL SURFACE STRUCTURE FOR CONDENSATION ENHANCEMENT AND PREPARATION METHOD AND USE THEREOF

(71) Applicants: Guangzhou Institute of Technology, Xidian University, Guangzhou (CN); Xidian University, Xian (CN)

(72) Inventors: Jingtan Chen, Guangzhou (CN); Yafan Qin, Guangzhou (CN); Hao Wang, Guangzhou (CN); Ke Zhang, Guangzhou (CN); Zhihai Wang, Guangzhou (CN); Shikun Zheng, Guangzhou (CN); Xiaofei Ma, Guangzhou (CN); Yuanpeng Zheng, Guangzhou (CN); Congsi Wang, Guangzhou (CN)

(73) Assignees: Guangzhou Institute of Technology, Xidian University, Guangzhou (CN); Xidian University, Xian (CN)

( * ) Notice: Subject to any disclaimer, the term of this patent is extended or adjusted under 35 U.S.C. 154(b) by 0 days.

(21) Appl. No.: 19/393,518

(22) Filed: Nov. 18, 2025

(51) Int. Cl.
*F28F 13/18* (2006.01)

(52) U.S. Cl.
CPC ..... *F28F 13/187* (2013.01); *F28F 2245/04* (2013.01)

(58) Field of Classification Search
CPC ..... F16K 15/00; F28F 13/187; F28F 2245/00; F28F 2245/02; F28F 2245/04; F28F 2245/06; F28F 2245/08
See application file for complete search history.

(56) References Cited

U.S. PATENT DOCUMENTS

2024/0049428 A1* 2/2024 Li ..... H05K 7/20327
2025/0165682 A1* 5/2025 Wang ..... G06F 30/17

FOREIGN PATENT DOCUMENTS

CN 112228596 A * 1/2021 ..... F16K 15/00
CN 213907283 U * 8/2021
CN 114651546 A * 6/2022 ..... A01B 77/00
(Continued)

OTHER PUBLICATIONS

Translation of CN115397195A named Translation-CN115397195A (Year: 2022).*

(Continued)

*Primary Examiner* — Paul Alvare
(74) *Attorney, Agent, or Firm* — Hawaii Patent Services; Nathaniel K. Fedde; Kenton N. Fedde

(57) ABSTRACT

The invention belongs to the technical field of phase-change heat transfer enhancement, and particularly discloses a multifunctional surface structure and a preparation method and use thereof for condensation enhancement. The multifunctional surface structure for condensation enhancement includes a copper substrate. A plurality of Tesla valve passages are parallelly arranged on a surface of the copper substrate. A diamond bump with a flared slope is arranged on the surface of the copper substrate between each side passage and the corresponding main passage. The surface of the copper substrate and surfaces of the diamond bumps and the Tesla valve passages are covered with a composite hydrophobic coating. The heat-transfer performance of the surface structure is remarkably improved.

8 Claims, 8 Drawing Sheets

(56) References Cited

FOREIGN PATENT DOCUMENTS

| | | | | | |
|---|---|---|---|---|---|
| CN | 115397195 | A | * | 11/2022 | ..... H05K 7/20272 |
| CN | 115540641 | A | * | 12/2022 | ..... F28D 7/16 |
| CN | 221432998 | U | * | 7/2024 | |
| CN | 119465212 | A | * | 2/2025 | ..... C25B 9/19 |
| CN | 120456529 | A | * | 8/2025 | ..... H05K 7/20318 |
| TW | 1808656 | B | * | 7/2023 | ..... H05K 7/2029 |

OTHER PUBLICATIONS

Translation of CN115540641A named Translation-CN115540641A (Year: 2022).*
Translation of TWI808656B named Translation-TWI808656B (Year: 2023).*
Translation of CN213907283U named Translation-CN213907283U (Year: 2021).*
Translation of CN120456529A named Translation-CN120456529A (Year: 2025).*

* cited by examiner

MULTIFUNCTIONAL SURFACE STRUCTURE FOR CONDENSATION ENHANCEMENT AND PREPARATION METHOD AND USE THEREOF

BACKGROUND OF THE INVENTION

1. Technical Field

The invention relates to the technical field of phase-change heat transfer enhancement, in particular to a multifunctional surface structure for condensation enhancement and a preparation method and use thereof.

2. Description of Related Art

The condensation heat transfer process is prevalent in many engineering fields such as electronic device cooling systems, solar-powered seawater desalination, water collection for power generation, advanced thermodynamic cycles and nuclear safety emergency systems. Since the condensation heat transfer process is a vapor-liquid phase change process, a large quantity of latent heat is absorbed, thereby achieving high energy transfer efficiency. In actual application, the heat transfer efficiency may be further improved by controlling liquid transfer behaviors on a cooling surface, to improve energy use efficiency, reduce carbon emission and maintain environmental sustainability. However, a high-resistance liquid film is easily formed between vapor and the cooling surface, leading to a sharp deterioration of the heat-transfer performance in a filmwise condensation mode. To overcome such a critical defect, numerous theoretical and engineering studies have been carried out to attempt to maintain a dropwise condensation mode in the condensation process by changing the micro/nano-morphology of the surface.

To realize efficient dropwise condensation, droplet motion behaviors on a condensation surface, including nucleation, gathering and separation of droplets, need to be controlled by a subtle micro/nanoscale design. On a traditional superhydrophobic surface, droplets are gathered too fast under a high degree of subcooling, which irreversibly results in filmwise condensation. As a result, some multifunctional surfaces with a specific fluid dynamics mechanism, such as a low nucleation barrier and droplet jump induced by coalescence, have great potential in stable dropwise condensation and high thermal performance. These mechanism-oriented surface designs with micro-features have good condensation enhancement performance owning to their improvement in certain fluid dynamics mechanisms.

However, at present, the micro/nanoscale structural design of main multifunctional surfaces still lacks a clear exploration of the coupled droplet transport mechanism, and most studies are carried out in a humid air environment with a low degree of subcooling or in an approximately pure vapor environment with a low-concentration non-condensable gas. It is predictable that novel multifunctional surface structure design schemes are needed under the conditions of a high degree of subcooling and a high non-condensable gas content, for application scenarios including, but not limited to, nuclear safety emergency systems, ultralow-temperature condensers, etc.

Therefore, a multifunctional surface structure for condensation enhancement and a preparation method thereof need to be designed urgently to achieve stable dropwise condensation in a wider subcooling range.

BRIEF SUMMARY OF THE INVENTION

To solve the aforementioned technical problems, the invention provides a multifunctional surface structure for condensation enhancement and a preparation method and use thereof. The surface structure based on diamond bumps and Tesla valve passages promotes nucleation, gathering and sliding of droplets and maintains dropwise condensation under a high degree of subcooling by means of a multiscale structural design and a composite coating process, thereby greatly improving heat transfer efficiency.

To fulfill the above objective, the invention is implemented according to the following technical solutions:

A first technical solution provided by the invention is a multifunctional surface structure for condensation enhancement, including a copper substrate, wherein a plurality of Tesla valve passages are parallelly arranged on a surface of the copper substrate, each Tesla valve passage includes a main passage and a plurality of side passages distributed on two sides of the main passage, a diamond bump with a flared slope is arranged on the surface of the copper substrate between each side passage and the corresponding main passage, pointed ends of the diamond bumps are distributed in a flow direction of the Tesla valve passages and connected to the main passages of the Tesla valve passages, and the asymmetric passages enlarge a droplet sweeping area by about 142.1% and restrain filmwise concentration; and the surface of the copper substrate and surfaces of the diamond bumps and the Tesla valve passages are covered with a composite hydrophobic coating.

The invention is based on a collaborative optimization mechanism: the diamond bumps accelerate droplet nucleation and gathering, the Tesla valve passages optimize the sliding path, the composite hydrophobic coating prevents filmwise condensation of pores on the micro/nanoscale, and the heat transfer efficiency is improved by 447.5% on the whole.

Further, the diamond bumps have a height of 0.506 mm and a width of 1.016-1.644 mm, and a distance from a top to edges of the diamond bumps is 1.56-2.19 mm; and the Tesla valve passages have a depth of 0.51 mm and a width of 0.935 mm.

Further, the composite hydrophobic coating is a Ag/PTFE hybrid coating.

Preferably, a silver coating in the Ag/PTFE hybrid coating is a porous silver coating and has a thickness of 1.2 μm; and a PTFE coating has a thickness of 1.2 μm and a water contact angle of 112.03°.

Preferably, the diamond bumps have a width of 1.337 mm and a length of 2.018 mm, and the distance from the top to the edges of the diamond bumps is 1.90 mm.

A second technical solution provided by the invention is a preparation method of the multifunctional surface structure for condensation enhancement, including:

(1) pre-treatment of a base material: soaking the copper substrate in a 0.1 mol/L diluted hydracid solution for 10 min; then, washing the surface of the copper substrate with deionized water; then, cleaning the surface of the copper substrate in acetone and ethyl alcohol; and finally, washing again the surface of the copper substrate with deionized water, and blow-drying the surface of the copper substrate;

(2) machining of the diamond bumps and the Tesla valve passages: machining the diamond bumps and the Tesla valve passages on the pre-treated surface of the copper substrate; and (3) preparation of the composite hydrophobic coating: adding 0.04 g of perfluorooctanoic acid powder to 53 g of deionized water, and stirring until the perfluorooctanoic acid powder is completely dissolved; next, adding 17 mL of a $AgNO_3$ solution with a concentration of 0.1 mol/L to obtain a $AgNO_3$/perfluorooctanoic acid solution; soaking the surface of the copper substrate with the diamond bumps and the Tesla valve passages in the $AgNO_3$/perfluorooctanoic acid solution for 2 min, then taking out the surface of the copper substrate, and naturally air-drying the surface of the copper substrate; and immersing the treated surface of the cooper substrate in a PTFE nano-coating solution by a dip coating method, then taking out the surface of the copper substrate, and naturally air-drying the surface of the copper substrate for more than one day to form the Ag/PTFE hybrid coating on the surface of the copper substrate and the surfaces of the diamond bumps and the Tesla valve passages.

Preferably, the PTFE nano-coating solution has a mass fraction of 5% and a nanoparticle size of 500 nm.

A third technical solution provided by the invention is a use of the multifunctional surface structure for condensation enhancement in a condensation heat transfer device.

Compared with the prior art, the invention has the following beneficial effects:

The invention adopts a hybrid coating method to improve the dropwise condensation effect. The hybrid coating method forms a silver coating by a chemical method and prepares a PTFE coating by dip coating to improve the heat conductivity and the robustness and avoid filmwise condensation on the micro/nanoscale. In the condensation heat transfer process of a plain copper surface, the performance is improved by about 204% as compared with filmwise condensation, and the stable droplet nucleation and sliding are still maintained under a high degree of subcooling (35 K).

The diamond bumps on the microscale provided by the invention realize efficient droplet nucleation owing to their heat flow concentration effect; in addition, with the aid of the Laplace pressure difference on the flared slopes, small droplets can gather together more rapidly, so the overall dropwise condensation effect is good. A condensation surface adopting the hybrid coating may remarkably increase the growth rate of droplets and improve the heat-transfer performance of dropwise condensation.

The improved Tesla valve passages (with a depth of 0.51 mm) in the invention overcome the defect of filmwise condensation under a high degree of subcooling by means of the asymmetric passage design, thus further enlarging the sweeping area in the droplet sliding process and effectively alleviating droplet stagnation and filmwise condensation at the bottom of the condensation surface.

The diamond bumps preferably with a width of 1.337 mm in the invention further optimize droplet behaviors by thermal-force field coupling. The pointed ends of the bumps allow for centralized heat diffusion to significantly increase the partial heat flux and the nucleation density, greatly shorten the refresh cycle of droplets on the surface and improve the performance by 447.5%.

The nucleation (heat diffusion)-gathering (pressure difference-based guidance)-sliding (directional sweeping) full-cycle collaboration mechanism in the invention provides a reliable solution to high-power condensation heat transfer application fields such as heat dissipation of electronic chips and seawater desalination condensers and is particularly suitable for condensation heat transfer devices.

DETAILED DESCRIPTION OF THE INVENTION

To better clarify the objectives, technical solutions and advantages of the invention, the invention is described in further detail below in conjunction with embodiments. The specific embodiments described here are merely used for explaining the invention rather than limiting the invention.

Figure 1:
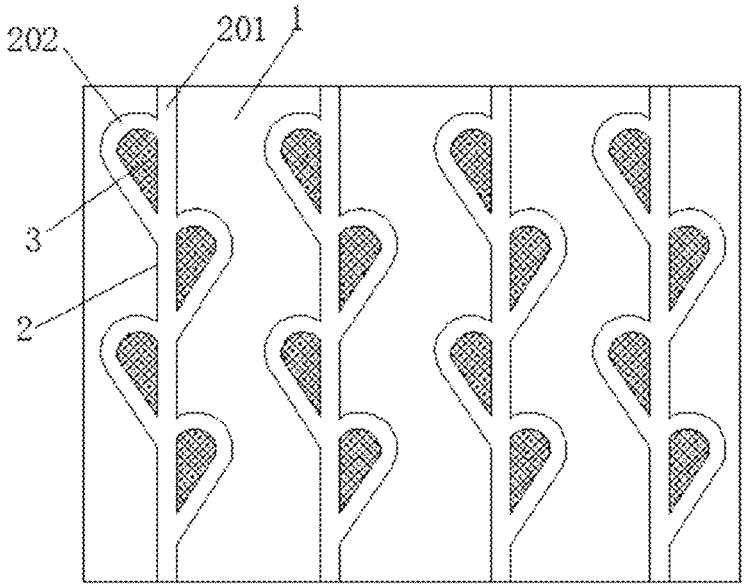
FIG. 1 illustrates diamond bumps and Tesla valve passages on a copper substrate according to an embodiment of the invention.

As shown in FIG. 1, an embodiment provides a multifunctional surface structure for condensation enhancement, including a copper substrate 1. A plurality of Tesla valve passages 2 are parallelly arranged on a surface of the copper substrate 1. Each Tesla valve passage 2 includes a main passage 201 and a plurality of side passages 202 distributed on two sides of the main passage 201. A diamond bump 3 with a flared slope is arranged on the surface of the copper substrate between each side passage 202 and the corresponding main passage 201. Pointed ends of the diamond bumps 3 are distributed in a flow direction of the Tesla valve passages and connected to the main passages 201 of the Tesla valve passages. The surface of the copper substrate 1 and surfaces of the diamond bumps 3 and the Tesla valve passages 2 are covered with a composite hydrophobic coating (not shown).

In this embodiment, the copper substrate 1 is made from high-purity copper with a length of 20 mm and a thickness of 1 mm, a structural modification on the micro/nanoscale is performed on the surface of the copper substrate 1 to enhance condensation, and droplet transport behaviors in the dropwise condensation process are further optimized by the structural design and the composite coating to improve the heat-transfer performance.

When the multifunctional surface structure for condensation enhancement is prepared, to remove a copper oxide layer of the copper substrate 1, the surface of the copper substrate 1 is soaked in 0.1 mol/L diluted hydracid for 10 min before coating. Then, the surface of the copper substrate 1 is washed with deionized water and then cleaned in an ultrasonic bath of acetone and ethyl alcohol. Then, the surface of the copper substrate 1 is blown to remove residual liquid to be coated with the composite hydrophobic coating by a chemical process. The composite hydrophobic coating is prepared as follows:

A silver/polytetrafluoroethylene (Ag/PTFE) hybrid coated surface is prepared by a two-step chemical process. In a first step, 0.04 g of perfluorooctanoic acid powder is added to 53 g of deionized water and stirred until the perfluorooctanoic acid powder is completely dissolved; next, 17 mL of a $AgNO_3$ solution is added (concentration: 0.1 mol/L); and the surface of the copper substrate is soaked in a $AgNO_3$/perfluorooctanoic acid solution for 2 min and then taken out to be air-dried naturally. In a second step, the treated surface is immersed in a PTFE nano-coating solution (mass fraction: 5%; nanoparticle size: 500 nm) by a dip coating method and then taken out to be naturally air-dried for more than one day to form a Ag/PTFE hybrid coating. A silver coating in the Ag/PTFE hybrid coating is a porous silver coating and has a thickness of 1.2 μm, and a PTFE coating has a thickness of 1.2 μm and a water contact angle of 112.03°.

Figure 2:
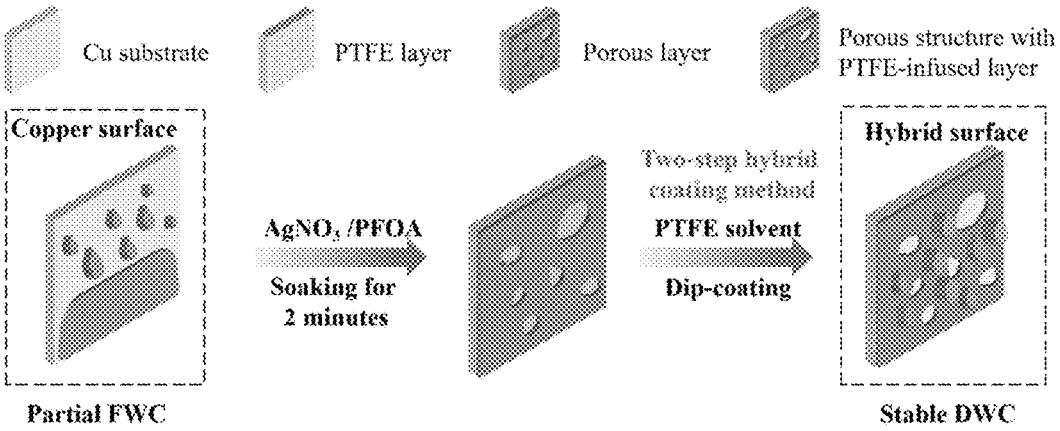
FIG. 2 illustrates a schematic flowchart of composite surface treatment according to an embodiment of the invention.
Figure 3:
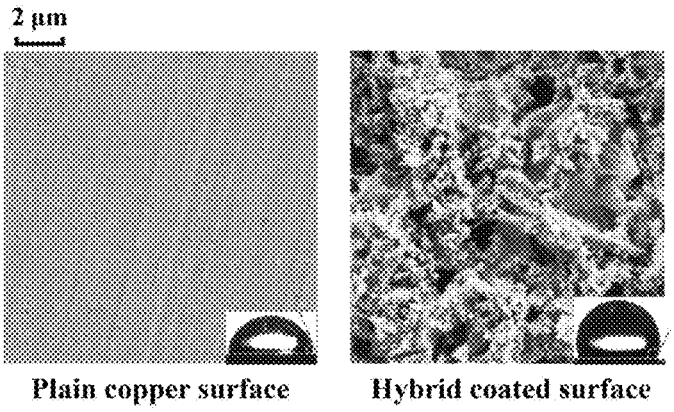
FIG. 3 illustrates SEM images of the micro/nanoscale structure of a treated surface according to an embodiment of the invention.
Figure 4:
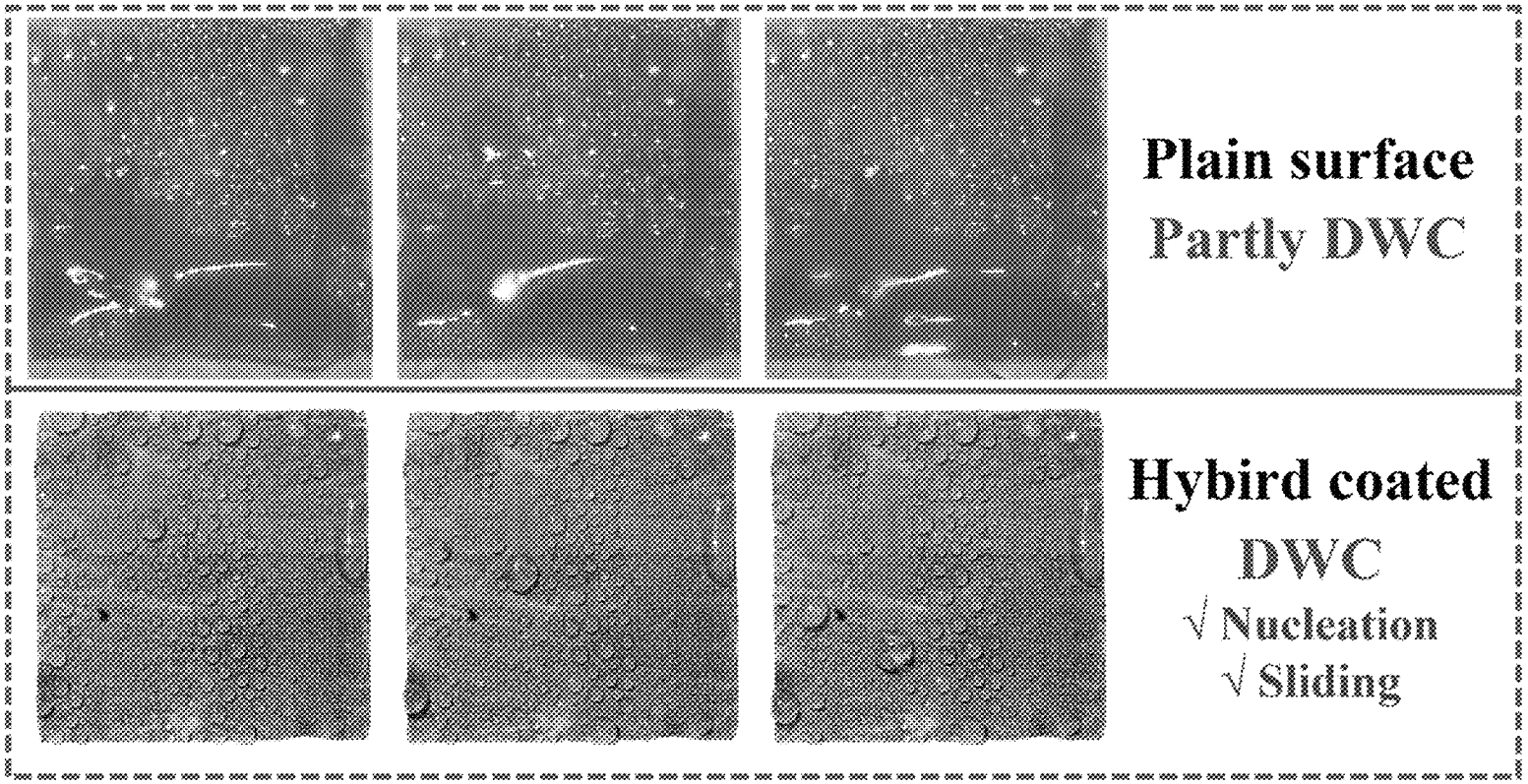
FIG. 4 illustrates pictures of condensation of a plain surface according to an embodiment of the invention.

FIG. 2 illustrates a schematic flowchart of surface treatment, and FIG. 3 illustrates SEM images of the treated surface. By surface treatment, the surface presents a multi-material and multiscale structure, which is formed by micro/nanoscale porous structures. In the condensation process, partial filmwise condensation and partial dropwise condensation will occur on a non-treated common metal surface. When droplets slide downwards, a liquid film is formed, resulting in irreversible filmwise condensation at the bottom of the surface, which will deteriorate partial heat transfer of the surface and finally reducing the thermal performance in the condensation process, as shown in FIG. 4. The two-step multi-material hybrid coating in the invention may effectively alleviate such a phenomenon. The silver structure with a high heat conductivity facilitates heat transfer, and the PTFE coating assists the porous bottom structure. It is verified by experiments that this embodiment achieves the optimal condensation enhancement effect of a plain structure, the heat transfer coefficient is increased by 204.2% as compared with filmwise condensation, both droplet nucleation and droplet sliding are enhanced, and the micro/nanoscale hybrid coating method remarkably increases the dynamic water contact angle by efficient droplet transport behaviors. Pictures of droplets on the surface with the hybrid coating are shown in FIG. 4.

Figure 5:
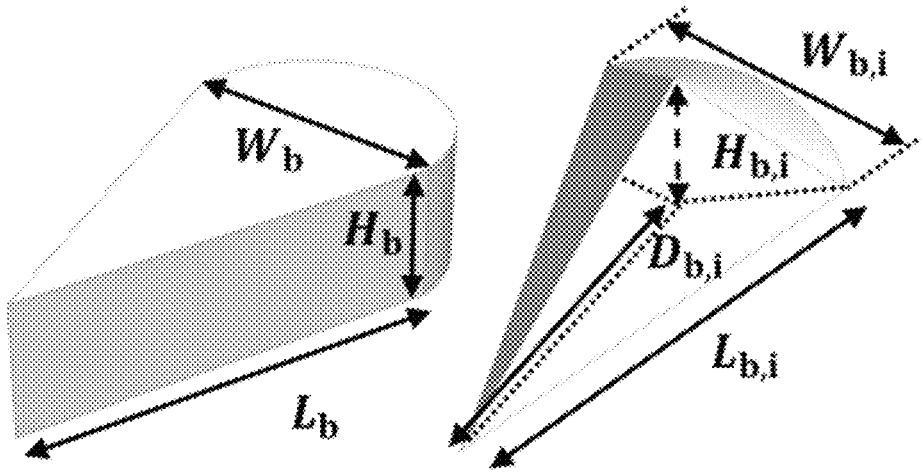
FIG. 5 illustrates schematic diagrams of a plain bump and a diamond bump according to an embodiment of the invention.
Figure 6:
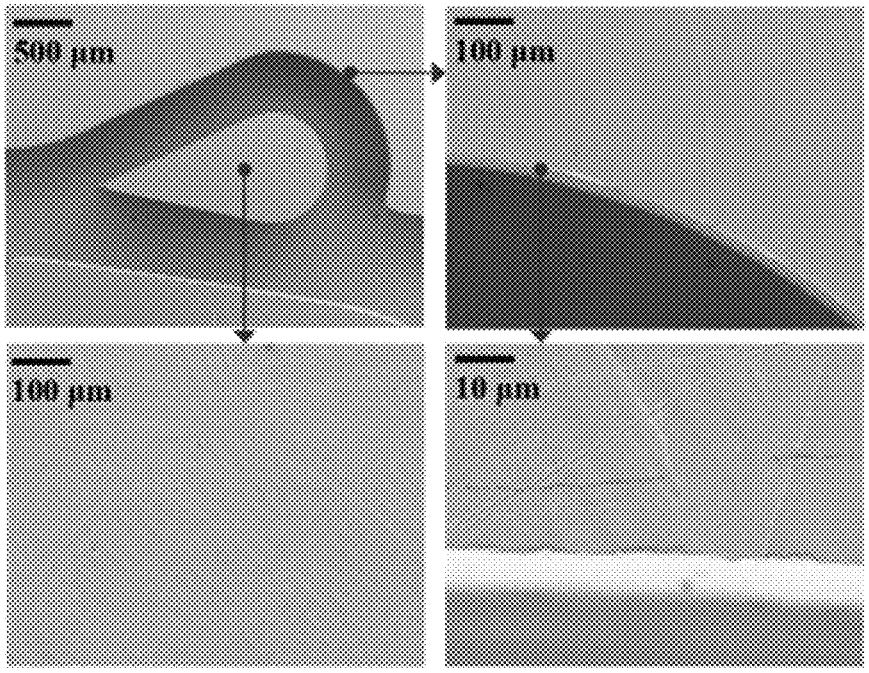
FIG. 6 illustrates SEM images of the plain bump according to an embodiment of the invention.
Figure 7:
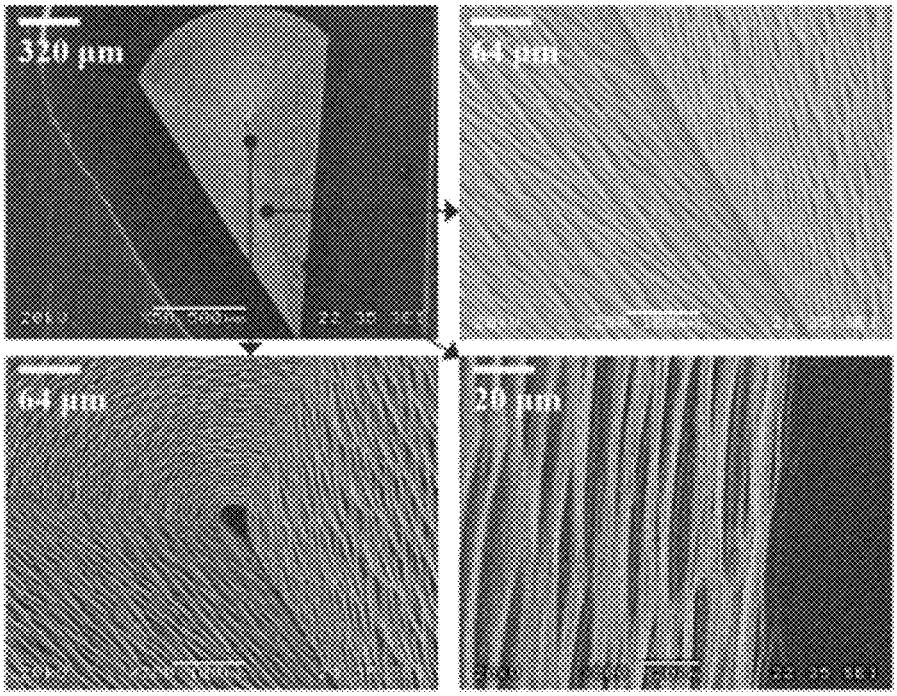
FIG. 7 illustrates SEM images of the diamond bump according to an embodiment of the invention.

In addition, regarding the design of the surface structure, first, the diamond bumps are engraved on the copper substrate by a high-precision machining method (such as a laser engraver), and then, the Tesla valve passages are engraved to connect the diamond bumps to realize efficient droplet transport behaviors. A precision machining method is adopted for surface engraving, with an average error of +20 μm. The performance of the diamond bumps is compared with the performance of plain bumps which are used as a control group, and the schematic diagrams of the two types of bumps are illustrated by FIG. 5. The SEM surface topography of the two types of bumps is shown in FIG. 6 and FIG. 7.

In one embodiment, the surface structure is a Tesla valve surface based on plain bumps and adopts a Ag/PTFE coating. The plain bumps have a height $H_b$ of 0.510 μm, a width $W_b$ of 0.935 mm and a length $L_b$ of 1.995 μm. Experiment results show that a large quantity of droplets, after being nucleated on the surfaces of the bumps, start to gather together and grow, and preferably migrate towards the bottom of the bumps. This surface structure is relatively ideal for droplets at the top of the bumps, is beneficial to droplet sliding in the next stage of droplet transport, and has a remarkable heat transfer enhancement effects as compared with a pure copper surface.

Figure 8:
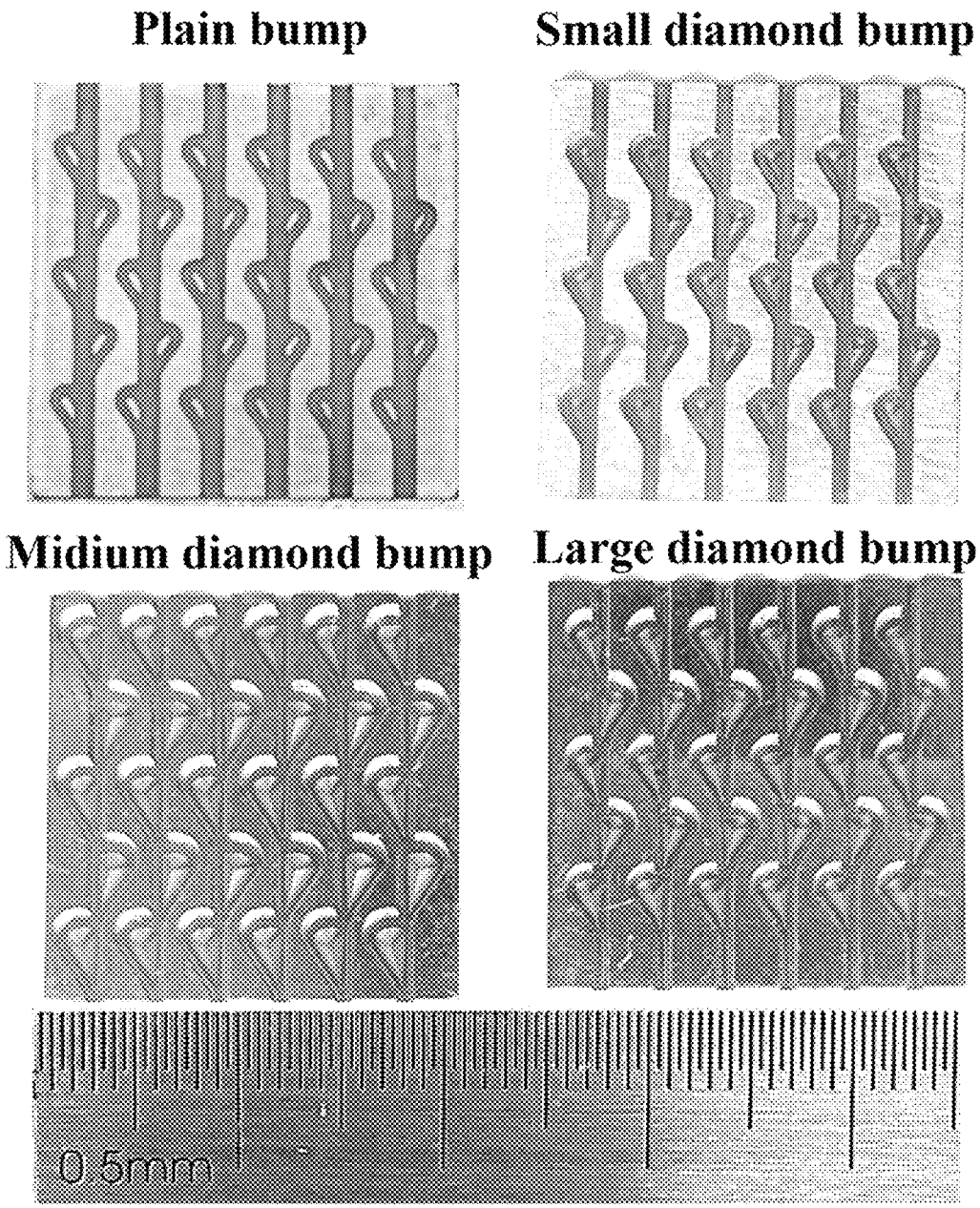
FIG. 8 illustrates design pictures of a surface structure according to an embodiment of the invention.

In one embodiment, the surface structure is a Tesla valve surface based on diamond bump structures. In the invention, three types of diamond bumps of different sizes (see FIG. 5) are compared, optimal structural parameters are proposed, and pictures of the three types of diamond bumps are shown in FIG. 8: the small diamond bumps have a height of 0.506 mm, a width of 1.016 mm and a length of 1.642 mm, and the distance from the top to the edges of the small diamond bumps is 1.56 mm; the medium diamond bumps have a height of 0.506 mm, a width of 1.337 mm and a length of 2.018 mm, and the distance from the top to the edges of the small diamond bumps is 1.90 mm; and the large diamond bumps have a height of 0.506 mm, a width of 1.644 mm and a length of 2.335 mm, and the distance from the top to the edges of the small diamond bumps is 2.19 mm.

Figure 10:
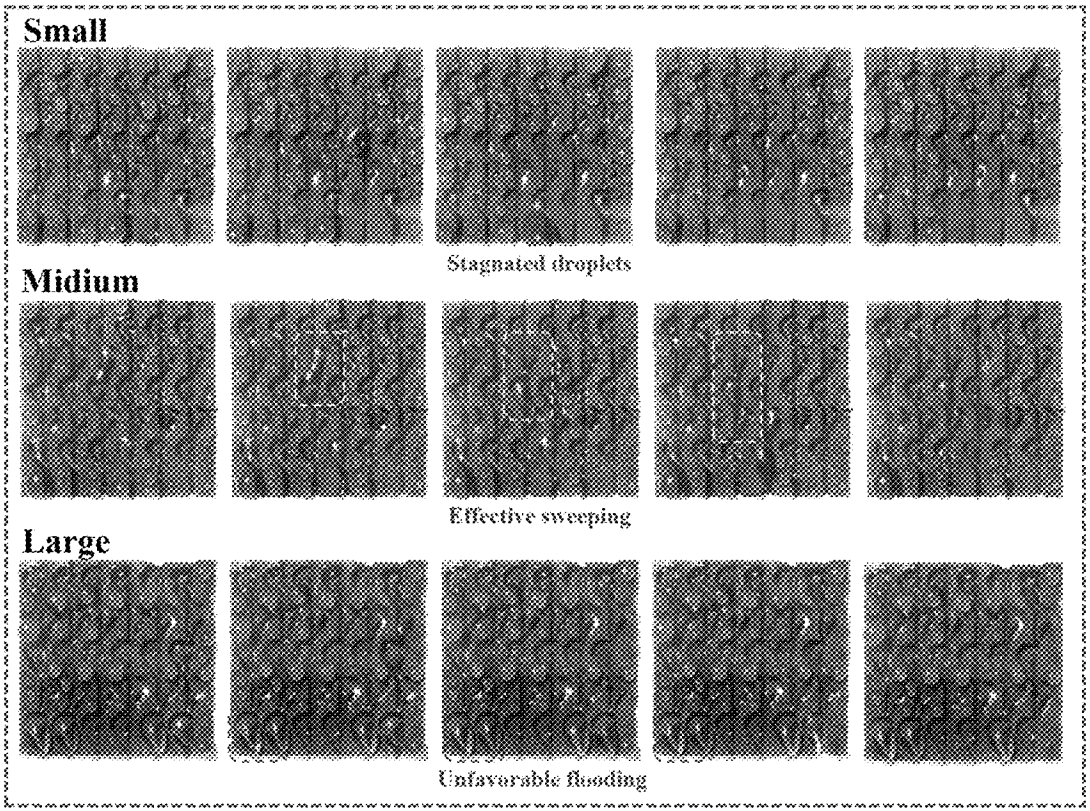
FIG. 10 illustrates pictures of a surface droplet transport behavior according to an embodiment of the invention.
Figure 11:
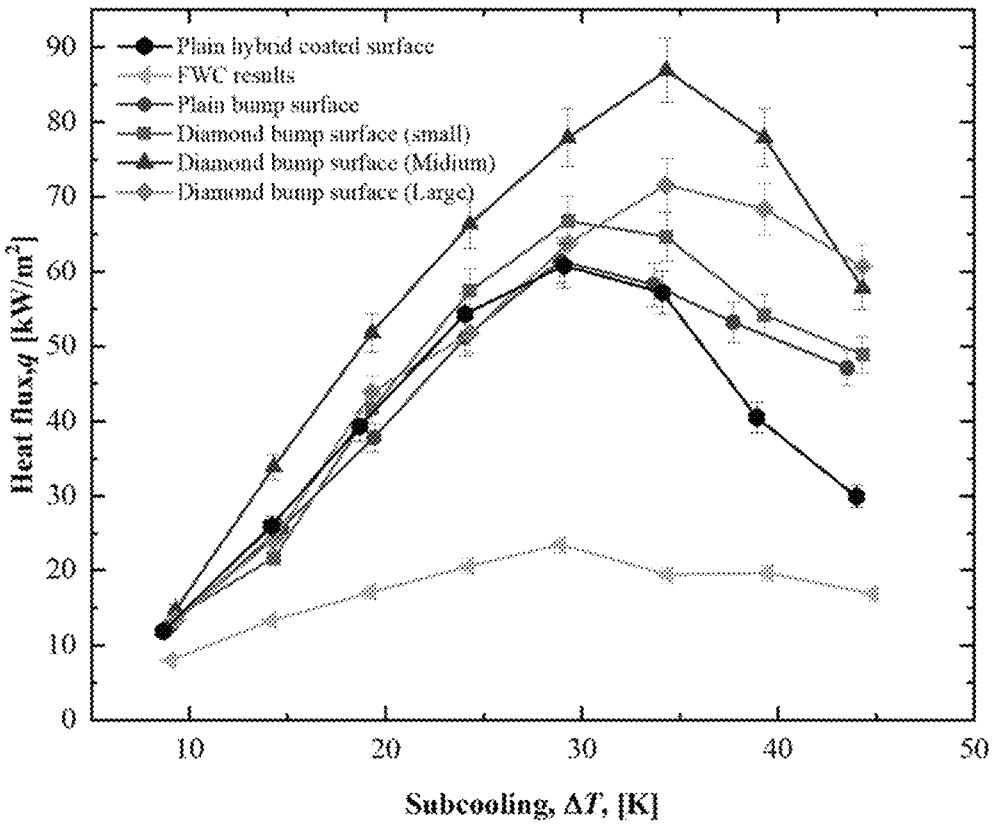
FIG. 11 illustrates a comparison chart of the condensation heat transfer enhancement performance of surfaces with diamond bumps and Tesla valve passages.

Pictures of droplet transport behaviors on the multifunctional surface adopting the surface structure design in the invention are shown in FIG. 10, and the comparison of thermal performance is shown in FIG. 11. Experiments show that the small bumps will lead to stagnation of droplets in flat regions of the surface, and the sliding and suction process of the droplets is unsatisfying, so the enhancement effect is not remarkable under a high degree of subcooling, as compared with common hybrid coated surfaces. The size of the large bumps is equivalent to the sliding radius of the droplets, so unfavorable filmwise condensation will be generated at the bottom of the surface. The large bumps capture sliding droplets to form a liquid film, which hinders the droplet transport behaviors. The bumps with the medium size fulfill the optimal enhancement effect and improve the performance by 447.5% under a high degree of subcooling of 35 K, and the surface with the medium bumps is obviously superior to the Tesla valve surface based on the plain bumps and the plain hybrid coated surface, indicating that the droplet transport behaviors are further improved by the microscale structure. Therefore, in this embodiment, the bumps preferably have a width of 1.337 mm and a length of 2.018 mm, and the distance from the top to the edges of the bumps is preferably 1.90 mm.

Figure 9:
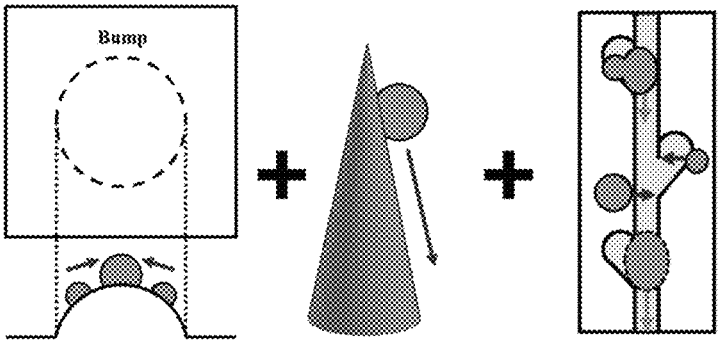
FIG. 9 illustrates a schematic diagram of a droplet transport (nucleation, gathering and sliding) enhancement mechanism according to an embodiment of the invention.

The heat-transfer enhancement mechanism is analyzed. As shown in FIG. 9, the droplets grow more quickly and migrate effectively in the bump regions, which promotes droplet gathering, and the size of the droplets in the bump regions is about twice that of the droplets in the flat regions, so the diamond bumps accelerate nucleation and gathering of the droplets and further enhance the heat-transfer effect, indicating that the Tesla valve passages in the invention greatly widen the droplet sweeping range in the sliding process of the droplets along the passages, thus improving the suction effect on the concave passages. Such sliding may be triggered by droplets falling from the flat regions or by the directional suction effect generated by liquid gradually accumulated in the bump regions, and may effectively alleviate droplet stagnation and filmwise condensation at the bottom of the condensation surface to realize an efficient droplet transport process.

In the invention, by means of the collaborative design of the composite coating and the micro/nanoscale structure, the condensation performance is remarkably improved on the micro/nanoscale. By means of the compound process based on a mechanical method and innovation of the geometric structure, the heat transfer coefficient of a common copper surface is increased by 447.5%, and stable dropwise condensation can still be maintained even under a high degree of subcooling of 45 K, which is of great significance for the study of the droplet transport enhancement mechanism and the improvement on the multi-field thermal management capacity. Therefore, the multifunctional surface structure for condensation enhancement in this embodiment may be applied to a condensation heat transfer device.

The technical solutions of the invention are not limited to the above specific embodiments. All technical deformations made according to the technical solutions of the invention should fall within the protection scope of the invention.

What is claimed is:

1. A multifunctional surface structure for condensation enhancement, comprising a copper substrate, wherein a plurality of Tesla valve passages are parallelly arranged on a surface of the copper substrate, each said Tesla valve passage comprises a main passage and a plurality of side passages distributed on two sides of the main passage, a diamond bump with a flared slope is formed in the copper substrate between each said side passage and the corresponding main passage, and pointed ends of the diamond bumps are distributed to be parallel with at least a portion of a flow direction of the Tesla valve passages and at least one pointed end of the diamond bumps intersects at least one portion of the Tesla valve passages; and the surface of the copper substrate and surfaces of the diamond bumps and the Tesla valve passages are covered with a composite hydrophobic coating.

2. The multifunctional surface structure for condensation enhancement according to claim 1, wherein the diamond bumps have a height of 0.506 mm and a width of 1.016-1.644 mm, and a distance from a top to edges of the diamond bumps is 1.56-2.19 mm; and the Tesla valve passages have a depth of 0.51 mm and a width of 0.935 mm.

3. The multifunctional surface structure for condensation enhancement according to claim 1, wherein the composite hydrophobic coating is an Ag/PTFE hybrid coating.

4. The multifunctional surface structure for condensation enhancement according to claim 3, wherein a silver coating in the Ag/PTFE hybrid coating is a porous silver coating and has a thickness of 1.2 μm; and a PTFE coating in the Ag/PTFE coating has a thickness of 1.2 μm and a water contact angle of 112.03°.

5. The multifunctional surface structure for condensation enhancement according to claim 2, wherein the diamond bumps have a width of 1.337 mm and a length of 2.018 mm, and the distance from the top to the edges of the diamond bumps is 1.90 mm.

6. A preparation method of the multifunctional surface structure for condensation enhancement according to claim 1, comprising:

(1) pretreatment of a base material: soaking the copper substrate in a 0.1 mol/L diluted hydracid solution for 10 min; then, washing the surface of the copper substrate with deionized water; then, cleaning the surface of the copper substrate in acetone and ethyl alcohol; and finally, washing again the surface of the copper substrate with deionized water, and blow-drying the surface of the copper substrate;

(2) machining of the diamond bumps and the Tesla valve passages: machining the diamond bumps and the Tesla valve passages on the pretreated surface of the copper substrate; and (3) preparation of the composite hydrophobic coating: adding 0.04 g of perfluorooctanoic acid powder to 53 g of deionized water, and stirring until the perfluorooctanoic acid powder is completely dissolved; next, adding 17 mL of a $AgNO_3$ solution with a concentration of 0.1 mol/L to obtain a $AgNO_3$/perfluorooctanoic acid solution; soaking the surface of the copper substrate with the diamond bumps the and Tesla valve passages in the $AgNO_3$/perfluorooctanoic acid solution for 2 min, then taking out the surface of the copper substrate, and naturally air-drying the surface of the copper substrate; and immersing the treated surface of the cooper substrate in a PTFE nano-coating solution by a dip coating method, then taking out the surface of the copper substrate, and naturally air-drying the surface of the copper substrate for more than one day to form the Ag/PTFE hybrid coating on the surface of the copper substrate and the surfaces of the diamond bumps and the Tesla valve passages.

7. The preparation method of the multifunctional surface structure according to claim 6, wherein the PTFE nano-coating solution has a mass fraction of 5% and a nano-particle size of 500 nm.

8. A condensation heat transfer device comprising a multifunctional surface structure for condensation enhancement according to claim 1.

* * * * *